US010124933B2

(12) United States Patent
Tseng et al.

(10) Patent No.: US 10,124,933 B2
(45) Date of Patent: Nov. 13, 2018

(54) BAG WITH RE-SEALABLE AND TEARABLE BAND

(71) Applicant: Inteplast Group, Ltd., Livingston, NJ (US)

(72) Inventors: Ben Tseng, East Brunswick, NJ (US); Ter-Hai Lin, Sugar Land, TX (US); Kelvin Yang, Madison, NJ (US); Jyh-yao Raphael Li, Parsippany, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 260 days.

(21) Appl. No.: 14/802,350

(22) Filed: Jul. 17, 2015

(65) Prior Publication Data

US 2016/0016694 A1 Jan. 21, 2016

Related U.S. Application Data

(60) Provisional application No. 62/026,320, filed on Jul. 18, 2014.

(51) Int. Cl.
*B65D 33/18* (2006.01)
*B65D 75/58* (2006.01)
*B65D 33/25* (2006.01)

(52) U.S. Cl.
CPC ..... *B65D 33/18* (2013.01); *B65D 33/2508* (2013.01); *B65D 75/58* (2013.01)

(58) Field of Classification Search
CPC ..... B65D 33/16; B65D 33/18; B65D 33/20
USPC ..... 428/67, 189, 194, 195.1, 43; 383/200–211
See application file for complete search history.

(56) References Cited

U.S. PATENT DOCUMENTS 3,535,409 A * 10/1970 Rohde ..... B29C 37/0057 264/171.28
3,565,737 A * 2/1971 Lefevre et al. ..... B29C 47/0021 156/244.11
5,965,254 A * 10/1999 Christopherson ..... B32B 7/06 428/349
6,054,209 A 4/2000 Imanishi et al.
2003/0064181 A1* 4/2003 Ingraham ..... B32B 7/06 428/35.2

(Continued)

FOREIGN PATENT DOCUMENTS

CN 103275377 A 9/2013

*Primary Examiner* — Jes F Pascua
*Assistant Examiner* — Nina Attel
(74) *Attorney, Agent, or Firm* — Stinson Leonard Street LLP

(57) ABSTRACT

A temporary adhesive band provides a releasable sealing structure and a tearing structure in a plastic bag. The band can be coextruded with one or more panels of the bag and can be made from a polymer blend. It can have a relatively thick tear section that defines a tear line at a zone of weakness in the bag so that a closed end of the bag can be easily removed. The band also can have a releasable sealing section that remains attached to the bag after the closed end of the bag has been removed by tearing the bag along the tear line so that the bag can be resealed once it has been opened. The releasable sealing section of the temporary adhesive band is preferably made from a coextruded material with tacky properties so that no additional adhesive is required for resealing the bag.

21 Claims, 5 Drawing Sheets

(56) References Cited

U.S. PATENT DOCUMENTS

| | | | | |
|---|---|---|---|---|
| 2010/0205909 | A1* | 8/2010 | Zimmerman | B65D 33/20 53/434 |
| 2011/0162329 | A1 | 7/2011 | So | |
| 2013/0089280 | A1 | 4/2013 | Tseng et al. | |
| 2014/0065382 | A1 | 3/2014 | Koehn et al. | |

* cited by examiner

FIG. 4

| | Layer | Composition | Percentage of the layer | MD tear strength (g/mil thickness) | Tackiness |
|---|---|---|---|---|---|
| A | Monolayer | 100% LDPE | 100 | 167 | No |
| B | Monolayer | 100% C4 LLDPE | 100 | 207 | No |
| C | Monolayer | 100% HDPE | 100 | 12 | No |
| D | Temporary Adhesive Band layer | 80% C4 LLDPE + 20% PIB | 69.3 | 253 | Yes |
| | Panel layer | LDPE | 30.6 | | |
| E | Temporary Adhesive Band layer | 59% C4 LLDPE + 40% PIB + 1% FA | 66.7 | 31 | Yes |
| | Panel layer | LDPE | 33.3 | | |
| F | Temporary Adhesive Band layer | 44% C4 LLDPE + 15% homoPP + 40% PIB + 1% FA | 66.7 | 51 | Yes |
| | Panel layer | LDPE | 33.3 | | |
| G | Adhesive Segment layer | 60% C4 LLDPE + 40% PIB | 16.7 | 43 | Yes |
| | Panel layer | LDPE | 16.7 | | |
| | Weakening Segment layer | 99% C4 LLDPE + 1% FA | 66.7 | | |
| H | Adhesive Segment layer | 60% C4 LLDPE + 40% PIB | 16.7 | 18 | Yes |
| | Panel layer | LDPE | 16.7 | | |
| | Weakening Segment layer | 84% C4 LLDPE + 15% homoPP + 1% FA | 66.7 | | |

BAG WITH RE-SEALABLE AND TEARABLE BAND

FIELD OF THE DISCLOSURE

Aspects of the present disclosure relate generally to sealable bags and more specifically to a releasable and tearable adhesive structure for use with a sealable bag.

BACKGROUND OF THE DISCLOSURE

Sealable bags are used for many different applications, such as shipping, food packaging, biohazard disposal, etc. Sealable bags generally include a permanent or a temporary sealing structure, depending on the application. Some sealable bags include a peelable seal, or a permanent seal that must be unsealed before the bag can be used. Other sealable bags include a permanent seal or fusion seal that must be removed from the bag to permit access to the interior of the bag. However, an initially sealed bag may not be preferable, because repeated use of the bag before permanent sealing may be desired.

SUMMARY

In one aspect, the present disclosure describes a temporary adhesive band that simultaneously provides a releasable sealing structure and a tearing structure in a plastic bag.

Other objects and features will be in part apparent and in part pointed out hereinafter.

BRIEF DESCRIPTION OF THE DRAWINGS

FIG. 4 is a table listing films that were subjected to tear strength and tackiness tests.

Corresponding reference characters indicate corresponding parts throughout the drawings.

DETAILED DESCRIPTION

Figure 1:
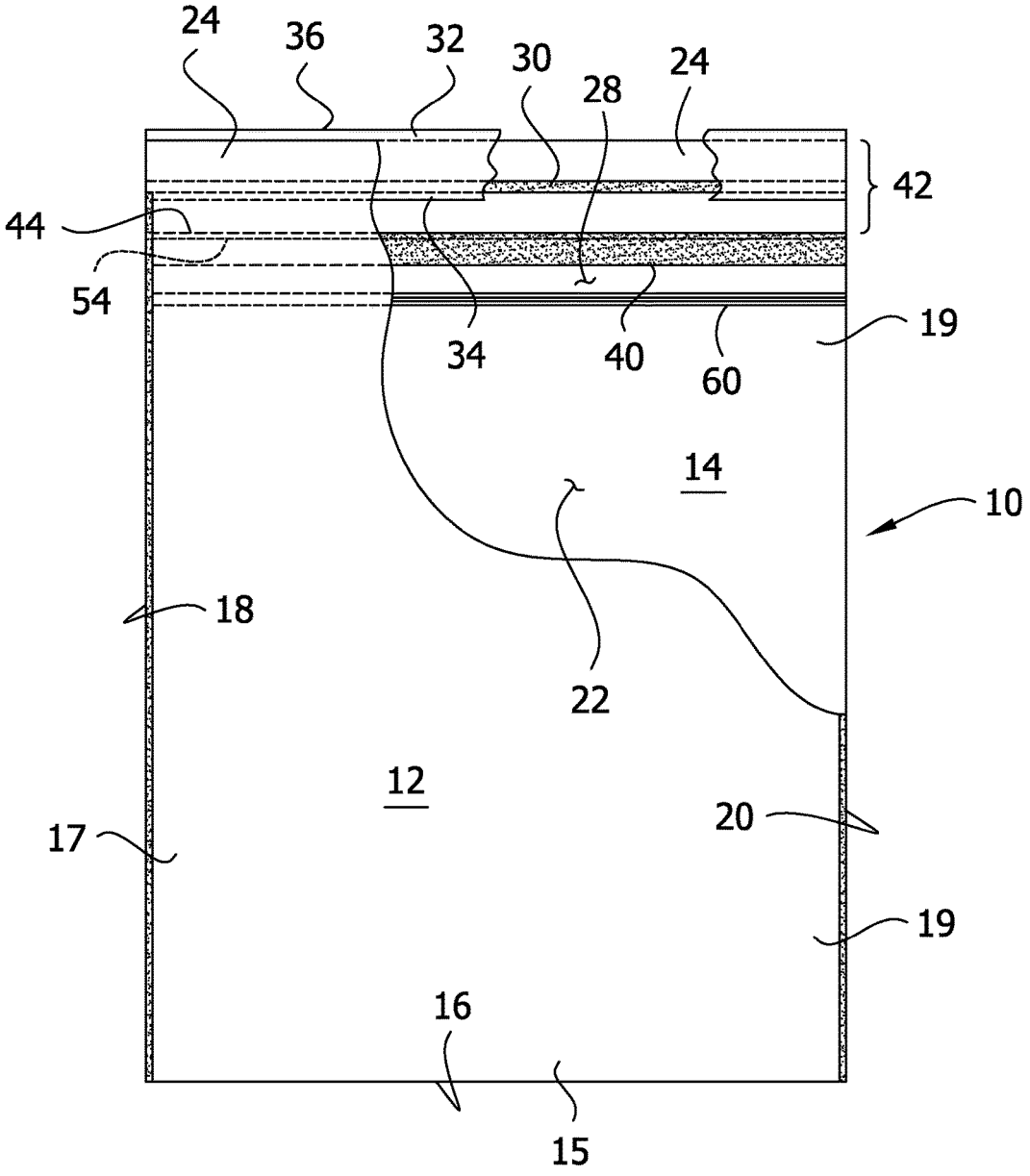
FIG. 1 is a front elevation of a sealable bag with parts broken away to show internal construction.
Figure 2:
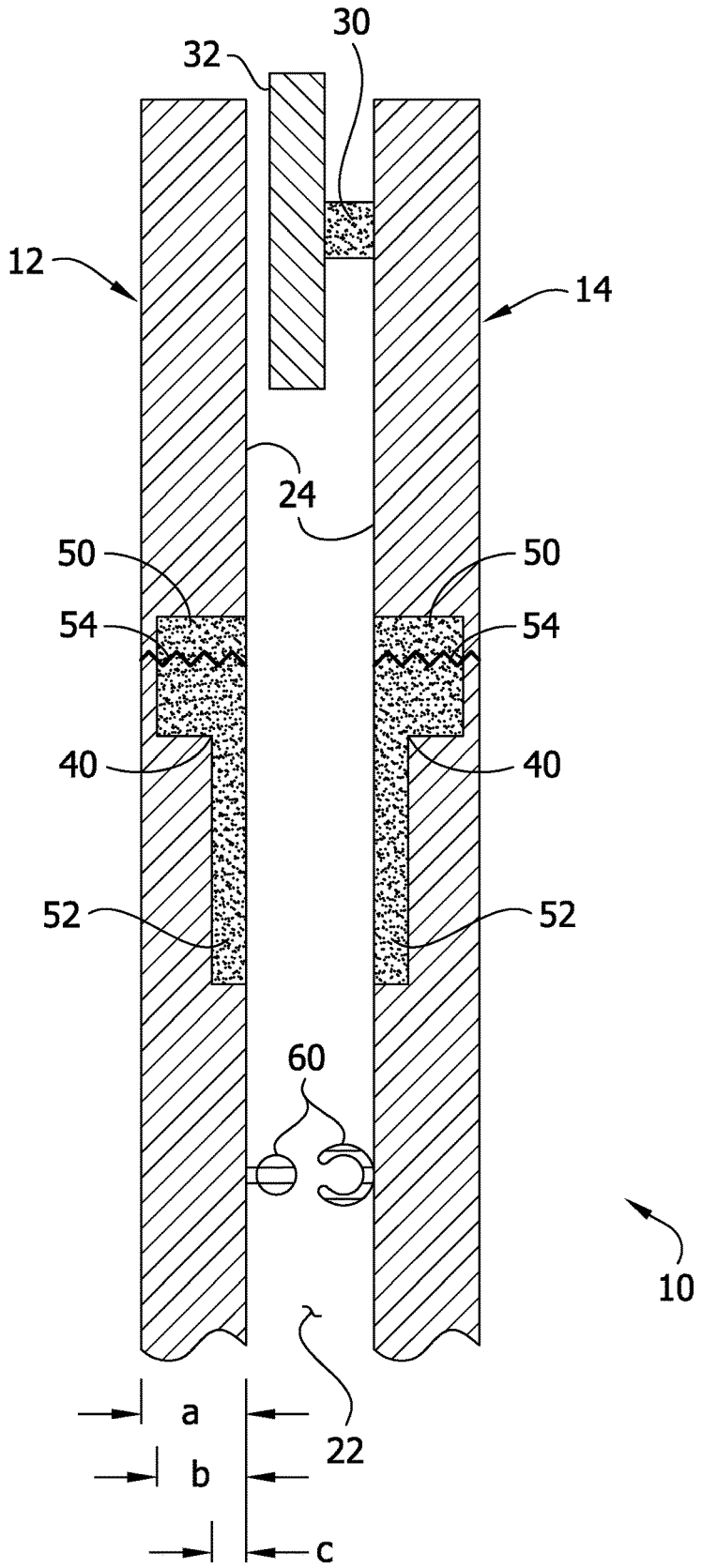
FIG. 2 is a fragmentary cross section of the sealable bag of FIG. 1.

Referring to FIGS. 1 and 2, a sealable bag is shown generally at 10. The sealable bag 10 includes coextensive front and back panels 12 and 14, respectively (broadly, first and second panels). Each panel 12, 14 is four-sided and has a top margin 24, bottom margin 15, and side margins 17, 19 (each of the margins 24, 15, 17, 19 is broadly an "end margin"). The panels 12, 14 are joined at the bottom margin 15 and side margins 17, 19 of the bag 10. In one embodiment, the panels 12, 14 are formed as a single sheet of material that is folded at the bottom of the bag 10 along a linear fold 16. The side margins 17, 19 are joined together by fusion lines 18 and 20. The panels 12, 14 can be joined in other manners within the scope of this invention. For example, the panels may be formed as separate sheets and fused together along the bottom margin 15 and side margins 17, 19. Whether the panels 12, 14 are formed as one piece and folded over, or formed as two pieces, the end margins 15, 17, 19 are considered to be "joined" together for purposes of this description. In some embodiments, the end margins are joined to form a fluid tight, liquid tight, and/or gas tight seal. In other embodiments, the end margins can be joined without forming a seal. Furthermore, in some embodiments, the panels 12, 14 may not be coextensive. For example, the top of one of the panels can extend above the top of the other panel, a side of one of the panels can extend beyond the corresponding side of the other panel, or the bottom of one of the panels can extend below the bottom of the other panel. As used throughout the present disclosure with respect to the bag, the terms defining relative locations and positions of structures and components of the bag, including but not limited to the terms "top," "bottom," "side," "front," and "back," are meant to provide a point of reference for such components and structures as shown in the drawings, with the understanding that the respective relative locations of such components and structures will depends on the orientation of the bag in use.

The joined panels 12, 14 define a bag interior 22 for receiving items placed in the bag 10. The top margins 24 of the panels 12, 14 can be initially unsecured along their length to define an opening 28 permitting access to the bag interior 22 and its contents. It will be understood that, though the top of the bag 10 defines the opening 28 in the illustrated embodiment, in other embodiments, the sides or bottom of the bag can define the opening without departing from the scope of the invention. Likewise, it will be understood that in some embodiments a bag can have more or fewer than four ends. In any case, corresponding end margins of joined panels can define an opening that is sealable in accordance with the principles set forth below. In the illustrated embodiment, a continuous band or layer of adhesive 30 extends along the inner surface of the top margin 24 of the back panel 14 between the sides thereof. Other configurations of the band of adhesive are within the scope of the present invention. For example, the band of adhesive can extend along the front panel 12, or each panel can include a band of adhesive.

A release liner strip 32 initially separates the adhesive band 30 from the inner surface of the front panel 12. The release liner strip 32 extends continuously along the entire length of the adhesive band 30, e.g. continuously between the side edges of the back panel 14. In the illustrated embodiment, a bottom edge 34 of the release liner strip 32 extends below the adhesive band 30, and a top edge 36 of the release liner strip extends above the adhesive band. Other configurations of the release liner strip are within the scope of the present invention.

Preferably, the adhesive band 30 is a type of adhesive that adheres strongly on contact with the material of the panels 12, 14. Thus, once the panels 12, 14 are sealed to each other by the adhesive band 30, they cannot be unsealed without at least partial destruction of the bag. Preferably, the adhesive band 30 is arranged so that the panels 12, 14 are sealed from side-to-side such that the bag interior 22 is air and/or liquid tight. The adhesive band 30 is a permanent adhesive layer that permanently adheres the panels 12, 14 to each other. In one embodiment, the panels 12, 14 are formed of a thermoplastic sheet material, such as a polyethylene (hereinafter, "PE"), a polypropylene (hereinafter, "PP"), a polybutylene (hereinafter, "PB"), and copolymers thereof and the adhesive band 30 includes an adhesive that adheres strongly on contact with thermoplastic sheet material. An example of such an adhesive is a hot melt glue marketed by National Starch and Chemical Corporation, New York, N.Y., under the registered trademark "DURO-TAK."

In one embodiment, the connections of the panels 12, 14 along the side margins 17, 19 of the bag 10, represented by the fusion lines 18, 20, terminate at or are discontinued at the bottom edge 34 of the release liner strip 32, so that the release liner strip delimits an unconnected or free marginal portion in both panels. As a result, the front panel 12 can be folded away from the release liner strip 32 and the back panel 14 at the top of the bag 10 for easy access to and removal of the release liner strip. In order to form the bag 10 with this feature, the release liner strip 32 is preferably formed of a material that is both easily releasable from the adhesive band 30 and prevents the formation of the fusion lines 18 and 20 during formation of the bag 10. For example, the release liner strip 32 can be formed from high density PE (hereinafter, "HDPE") coated with silicone on one surface to enable its release from the adhesive band 30, and the release liner strip can additionally include a silicone coating on the side facing the front panel 12. As a result of the silicone coating on both sides, heat fusion of the panels 12, 14 is prevented over the width of the release liner strip 32. Alternatively, the strip 32 can be formed of paper coated with silicone on only one side to enable release of the strip from the adhesive band 30. A material such as paper will also prevent the formation of a fusion line through both layers of the plastic material forming the panels 12, 14. It is understood that this feature may be omitted, and the side edges of the panels may be fused along their entire lengths within the scope of the present invention.

The illustrated embodiment depicts but one suitable example of a permanent seal along the top margin 24 of the panels 12, 14 of the bag 10 to permanently seal the opening 28 of the bag. It is contemplated that other permanent seals can also be used to permanently seal an opening of a bag without departing from the scope of invention. For example, it is contemplated that the bag 10 can be free from permanent adhesive until it is filled with suitable contents, at which point a permanent adhesive can be applied to the top margin 24 of one or both of the panels 12, 14. Likewise, it is contemplated that the first and second panels 12, 14 can be fused or otherwise joined to form a permanent seal along their top margins 24. Still other permanent seals can also be used without departing from the scope of the invention. In preferred embodiments, the permanent seal forms a fluid tight, liquid tight, and/or gas tight seal at the top margin 24 of the panels 12, 14.

The bag 10 also includes a temporary adhesive band 40 extending continuously between the side edges of the bag along an inner surface of the top margin 24 of each of the panels 12, 14. In the illustrated embodiment, the permanent adhesive band 30 is located at an outer portion of the top margin 24 of the panels 12, 14 and temporary adhesive band 40 is located at an inner portion of the top margin 24 (i.e., inboard of (e.g., below) the permanent adhesive band 30). The illustrated embodiment includes a temporary adhesive band 40 for each of the panels 12, 14. The temporary adhesive band 40 of the first panel 12 is oriented to contact the temporary adhesive band of the second panel 14 when the temporary adhesive bands are used to seal the opening 28. Though the illustrated embodiment includes a temporary adhesive band 40 for each of the panels 12, 14, it will be understood that other embodiments can have a temporary adhesive band on only one of the panels without departing from the scope of the invention. Each of the temporary adhesive bands 40 includes a continuous band or layer of adhesive 40. Each temporary adhesive band 40 is made from a different material than the panels 12, 14, and the material of the temporary adhesive band has lower tear strength than the material of the first and second panels 12, 14. As will be discussed in further detail below, the temporary adhesive band 40 is preferably a coextruded feature of the respective bag panel 12, 14 that functions to provide both a reclosable closure for the bag 10 and a tear structure for opening the bag after being permanently sealed.

Each of the temporary adhesive bands 40 has a tear section 50 and a releasable sealing section 52. The tear section 50 of each temporary adhesive band 40 is located outboard of (e.g., above) the respective releasable sealing section 52. The entire adhesive band 40 can be used to selectively seal, open, and re-seal the bag interior 22 prior to permanent sealing using the adhesive band 30. After permanent sealing, the tear section 52 provides a line of weakness to tear open the bag 10, removing the part with the permanent seal. The line of weakness, in the illustrated embodiment, is generally at the tear line 54 of each of the bands 40. The tear lines 54 are at an outer side of the temporary adhesive bands 40 such that the releasable sealing sections 52 of the temporary adhesive bands remain attached to the panels 12, 14 after they are torn along the tear lines to remove a portion thereof. The releasable sealing sections 52 of the temporary adhesive bands 40 are configured to repeatedly and nondestructively seal and unseal the first and second panels 12, 14 to close the opening 28 and prevent access to the bag interior 22 after the panels are torn along the tear line 54 and a portion thereof is removed.

Each tear section 50 and releasable sealing section 52 has a thickness. For each panel 12, 14, the thickness of the tear section 50 is thicker than the thickness of the releasable sealing section 52. Referring to FIG. 2, in the illustrated embodiment the first panel 12 has a thickness of a, the tear section 50 has a thickness of b, and the releasable sealing section 52 has a thickness of c. The thickness of the first panel 12 is greater than the thickness b of the tear section 50 and the thickness c of the releasable sealing section 52. However, in some embodiments, the thickness of the first panel 12 can be the same as the thickness b of the tear section 50 without departing from the scope of the invention. In preferred embodiments, the thickness b of the tear section 50 is between about 70% and about 100% of the thickness a of the first panel 12, and the thickness c of the releasable seal section 52 is between about 5% and about 50% of the thickness a of the first panel. In the illustrated embodiment, the temporary adhesive band 40 is disposed on the material of the first panel 12 such that the panel has a substantially uniform thickness.

The relatively thick tear sections 50 define tear lines 54 in each of the panels 12, 14. The panels are configured to tear along the tear lines 54 to expose the opening 28 and permit access to the bag interior 22. The relatively low tear strength of the material of the temporary adhesive band 40 tears more easily than the relatively high tear strength of the material of the panels 12, 14. Thus, when a tearing force is applied in a generally side-to-side direction at the top margin 24 of the panels 12, 14, the panels 12, 14 tend to tear along tear lines 54 in the temporary adhesive band 40 rather than elsewhere in the panels 12, 14. The jagged line labelled 54 is illustrative only, there being no preformed breaks extending through the tear sections 50 in the illustrated embodiment. Moreover, because the tear section 50 is thicker than the releasable sealing section 52, the bag 10 tends to tear along a tear line 54 in the tear section 50 rather than along a line in the releasable sealing section 54. Since the temporary adhesive band 40 is disposed inboard of the permanent sealing structure 30, tearing the panels 12, 14 along the tear lines 54 removes a permanently sealed outer portion 42 of the bag 10 at the top margin 24 of the panels to open the bag. Once the permanently sealed outer portion 42 has been removed, the releasable sealing section 50 remains attached to the bag 10 and can be used to reseal the opening 28. The releasable sealing section 52 is configured to repeatedly and nondestructively seal and unseal the first and second panels 12, 14 to close the opening 28 and contain articles or substances within the bag interior 22. In the illustrated embodiment, the sealing sections 52 of the panels 12, 14 are aligned so that, when the temporary adhesive band 50 is used to seal the opening 28, the releasable sealing sections are in continuous contact with one another between the side edges of the bag 10.

The temporary adhesive band 40 provides a structure for resealing the bag once the permanent seal 30 has been broke by tearing the bag 10 along the tear line 54. Preferably, the second adhesive band 40 is arranged so as to provide a temporary air and/or liquid tight seal of the interior space 22 when sealed. The panels 12, 14 can be sealed, unsealed, and resealed by the temporary adhesive band 40 and, more particularly, the releasable sealing section 52 repeatedly and nondestructively. If desired, additional releasable seals can be used in combination with the temporary adhesive band 40 without departing from the scope of the invention. For example, in the illustrated embodiment, a zippered seal 60 is used in combination with the temporary adhesive band 40. In other embodiments, other supplementary releasable sealing mechanisms can be used without departing from the scope of the invention. It should be understood that a supplementary releasable sealing mechanism such as the zippered seal 60 is optional, and therefore a bag can have only a temporary adhesive band as a resealing mechanism without departing from the scope of the invention.

Figure 3:
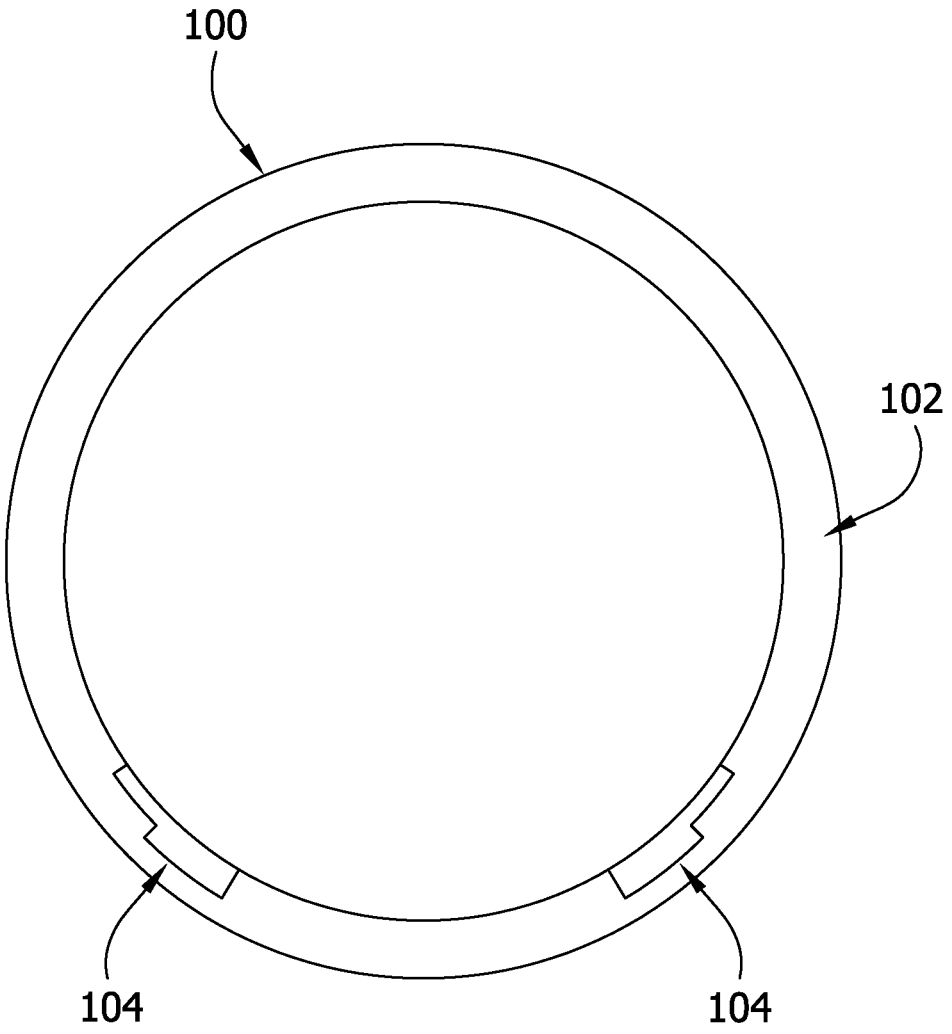
FIG. 3 is a schematic of a die lip for coextruding the sealable bag.

A suitable process for manufacturing the bag 10 will now be briefly described. In the illustrated embodiment, each of the temporary adhesive bands 40 is a coextruded section of a respective panel 12, 14. The panels 12, 14 are, in some embodiments, extruded in, for example, a blown film process. FIG. 3 depicts a suitable die lip 100 having a major panel section 102 and two band sections 104 along its inner circumference for coextruding panels 12, 14 along with the temporary adhesive bands 40. The temporary adhesive bands 40 can be extruded along with the panels 12, 14 in the same step. In a preferred embodiment, the panels 12, 14 and bands 40 are coextruded in a blown film process with a blow-up ratio of from about 2.2 to about 2.5, a barrel temperature of from about 330° F. to about 400° F., and a die temperature of about 380°. The bag 10 could also be extruded in a coextrusion process adhering to other parameters without departing from the scope of the invention. In still other embodiments, a temporary adhesive band can be attached to a bag panel using a manufacturing technique other than coextrusion without departing from the scope of the invention.

By coextruding the temporary adhesive bands 40 along with the panels 12, 14, certain additional manufacturing steps can be avoided. For example, in conventional sealed bags, perforations or embossments are provided on the bag to create a zone of weakness at which the bag is torn when opened. Thus, in order to make the bags, they must be perforated or embossed. By comparison, the tear section 50 of the illustrated bag 10 is non-perforated and non-embossed. A zone of weakness is, instead, created by the relatively lower tear strength of the material used for the temporary adhesive bands 40. In addition to a reduction in manufacturing steps, the co-extruded temporary adhesive bands 40 have the additional benefit of being free of any pores or openings. Thus, there are no perforations that permit fluid communication of the bag interior 22 with the external environment as with bags with conventional perforated tear lines. It should be understood, that perforations and/or embossments can be used in combination with a temporary adhesive band without departing from the scope of the invention. In addition, other tearing aids such as a tear starter notch on one or both of the side margins 17, 19 of either or both panels 12, 14 could also be used.

To manufacture a bag 10 with a functional temporary adhesive band 40 in a coextrusion process, the tear band must be formed from the proper material. In general, it is desirable for the material used for the temporary adhesive band 40 to have at least the following characteristics: it should readily bind with the material used for the bag panels 12, 14; it should have a low tear strength; and it should have a tacky quality that gives the tear band adhesive properties. One suitable class of materials for use as a tear band includes certain adhesive polymer blends. Some characteristics of exemplary adhesive polymer blends suitable for use as a temporary adhesive band will now be described.

Referring again to FIGS. 1 and 2, when the temporary adhesive bands 40 are coextruded with the panels 12, 14, it is preferable to use a polymeric material for the panels and a polymeric blend for the adhesive bands that includes a polymer of the same type as is used for the panels. For example, if the panels are made from a PE, it is preferable for the temporary adhesive bands 40 to be made from a polymeric blend partially composed of a PE or a PE-containing copolymer, contaminated with another type of material. If the panels are made from a PP, it is preferable for the temporary adhesive bands 40 to be made from a polymeric blend partially composed of a PP or a PP-containing copolymer, contaminated with another type of material. If the panels are made from a PB, it is preferable for the temporary adhesive bands 40 to be made from a polymeric blend partially composed of a a PB or a PB-containing copolymer, contaminated with another type of material. Etc. As will be discussed in further detail below, the low tear strength and adhesive properties of the temporary adhesive band 40 are preferably achieved by mixing the polymer of the same type as the panels with one or more additional materials.

Preferably, the temporary adhesive bands 40 are composed of a material having a lower tear strength than the bag panel material so the bag is torn along a tear line 54 located in the temporary adhesive band rather than the bag panels 12, 14. In certain embodiments, the low tear strength of the temporary adhesive bands 40 is achieved, in whole or in part, by forming the adhesive bands from a material comprising an immiscible polymer blend. An immiscible polymer blend has domains in the material that are rich in one or the other of the immiscible polymers in the blend. Whereas a miscible polymer blend or a single polymer is a homogenous material, immiscible polymer blends are heterogeneous. Weak material bonding occurs at interfaces between domains of the different polymers in an immiscible polymer blend. As a result, the material tears relatively easily at the interfaces. One suitable example of an immiscible polymer blend includes a mixture of a PE and a PP (e.g., an HDPE-PP mixture, etc.).

Though immiscible polymer blends can be used to form a temporary adhesive band 40 of sufficiently low tear strength, it is contemplated that other materials of relatively low tear strength can also be used without departing from the scope of the invention. For example, in one or more exemplary embodiments, the temporary adhesive bands 40 are extruded from a mixture of polymer and a foaming agent concentrate. Suitable foaming agent concentrates include organic or inorganic materials that decompose while being heated during the extrusion process (e.g., azodicarbonamide, N, N'-dinitrosopentamethylene tetramine, N,N'-dinitroso-N—N'-dimethyl terephthal amide, benzene sulfonyl hydrazide, benzene-1,3-disulfohydrazide, terephthalic azide and the like) and high pressure gases (e.g., carbon dioxide, nitrogen, etc.). Foaming agent concentrates may be combined with an immiscible polymer blend to form a low tear strength material for the temporary adhesive bands 40, or the foaming agents may be mixed with other polymers without departing from the scope of the invention. In one or more embodiments, the temporary adhesive bands are formed from a polymeric mixture comprising from about 0.01% to about 5% (e.g., from about 0.03% to about 3%) foaming agent by weight.

Temporary adhesive bands 40 may also be composed of polymeric mixtures comprising other types of fillers in addition or as an alternative to foaming agents and immiscible blends to provide low tear strength. Examples of suitable filler materials include talc, calcium carbonate, etc., which are known to reduce the tear strength of polymeric materials. It will be understood that immiscible polymeric mixtures, foaming agents, and filler materials may be used alone or in combination to produce a temporary adhesive band 40 of suitably low tear strength.

The temporary adhesive bands 40 are preferably made of a material with adhesive properties at room temperature. In one or more embodiments, temporary adhesive bands 40 are composed of a polymer blend comprising, in part, a cling agent concentrate, which gives the band an adhesive or tacky property at room temperature. In a preferred embodiment, the cling agent concentrate is a mixture of polyisobutylene and linear low density polyethylene (hereinafter, "LLDPE") comprising from about 53% to about 67% polyisobutylene by weight (hereinafter, "PIB"). Other suitable cling agent concentrates may also be used without departing from the scope of the invention. As discussed in further detail below, PIB is particularly well suited for being blended with PE or a PE-containing copolymer to form the temporary adhesive band because PIB is incompatible with PE and, in such a blend, tends to migrate toward the surface of the temporary adhesive band where its tacky properties enhance adhesiveness. In one or more embodiments, the temporary adhesive band 40 is formed from a polymeric mixture comprising from about 5% to about 50% (e.g., from about 10% to about 45%) cling agent concentrate by weight.

Certain additional material properties are thought to provide improved adhesion at room temperature. These properties can be present in any, all, or none of the individual polymers that make up a polymer blend of the temporary adhesive bands 40 without departing from the scope of the invention. In some embodiments, the temporary adhesive bands 40 include a material having a low melting point. In particular embodiments, the temporary adhesive bands are made of a material having a melting point between about 35° C. and about 110° C. For some materials (e.g., polyolefins), a lower melting point is thought to make the material tackier at room temperature. In addition, a material of the temporary adhesive bands 40 can have a high copolymer content, which also is thought to make the material tackier. The material of the temporary adhesive band can also have relatively low crystallinity and/or have a relatively low molecular weight. Each of these material properties is also thought to positively impact the tackiness of the material. In one embodiment, each temporary adhesive band comprises an immiscible polymer blend of PE copolymer and PP copolymer (e.g., a blend of metallocene PE and metallocene PP such as a blend of Affinity™ by Dow, which has a melting point between 55° C. and 106° C. depending on its composition, or Exact™ by ExxonMobil, which has a melting point between 27° C. and 69° C. depending on its composition, with Versify™ by Dow, which has a melting point between 55° C. and 107° C. depending on its composition).

In one or more preferred embodiments, the temporary adhesive bands are composed of a polymeric mixture having both low tear strength and an adhesive quality at room temperature. In a first example, the temporary adhesive bands 40 comprise an adhesive polymer blend including a PE (e.g., where the panel material is a PE such as low density polyethylene (hereinafter, "LDPE")) or a PE-containing copolymer, a foaming agent concentrate, and a cling agent concentrate. In this example, the PE component can be LDPE, LLDPE (e.g., C4, C6, C8, etc.), ethylene vinyl acetate copolymer (hereinafter, "EVA"), metallocene PE, etc. As discussed above, the polymeric mixture used to form the temporary adhesive bands 40 in the present example preferably comprises from about 5% to about 50% (e.g., from about 10% to about 45%) cling agent concentrate by weight and from about 0.01% to about 5% (e.g., from about 0.03% to about 3%) foaming agent concentrate by weight. Any suitable cling agent concentrate materials and foaming agent concentrate materials may be used without departing from the scope of the invention. One exemplary embodiment of a polymeric blend according to this first example is Film E, which is listed in the table of example films in FIG. 4 and discussed in further detail below.

A second example of a suitable composition for the temporary adhesive bands 40 is an adhesive polymer blend comprising a PE or a PE-containing copolymer, a PP, a foaming agent concentrate, and a cling agent concentrate. The PE or PE-containing copolymer, foaming agent and cling agents are the same as describe above for the first example. PP is immiscible with PE and certain PE-containing copolymers so that when the two are blended together with the foaming agent, the tear strength of the bands 40 is low. In one or more embodiments, the PP can be one of a homo polymer, copolymer, metallocene PP, etc. In the second example, the polymeric blend comprises from about 5% to about 40% and more preferably from about 10% to about 30% PP by weight. One exemplary embodiment of a polymeric blend according to this second example is Film F, which is listed in the table of example films in FIG. 4 and discussed in further detail below.

It has been recognized that certain cling agent concentrates, such as PIB, are incompatible with a PE and certain PE-containing copolymers but partially compatible with a PP. When such cling agent concentrates are blended with PE or a PE-containing copolymer (as described in the first example polymer blend above) the cling agent concentrate migrates to the film surface, making the surface tacky. But when such cling agent concentrates are blended with a PE-PP mixture (as described in the second example polymer blend above), some of the cling agent concentrate mixes with the PP, which prevents migration of the cling agent to the surface and adversely affects the tackiness of the resulting temporary adhesive band 40.

Figure 5:
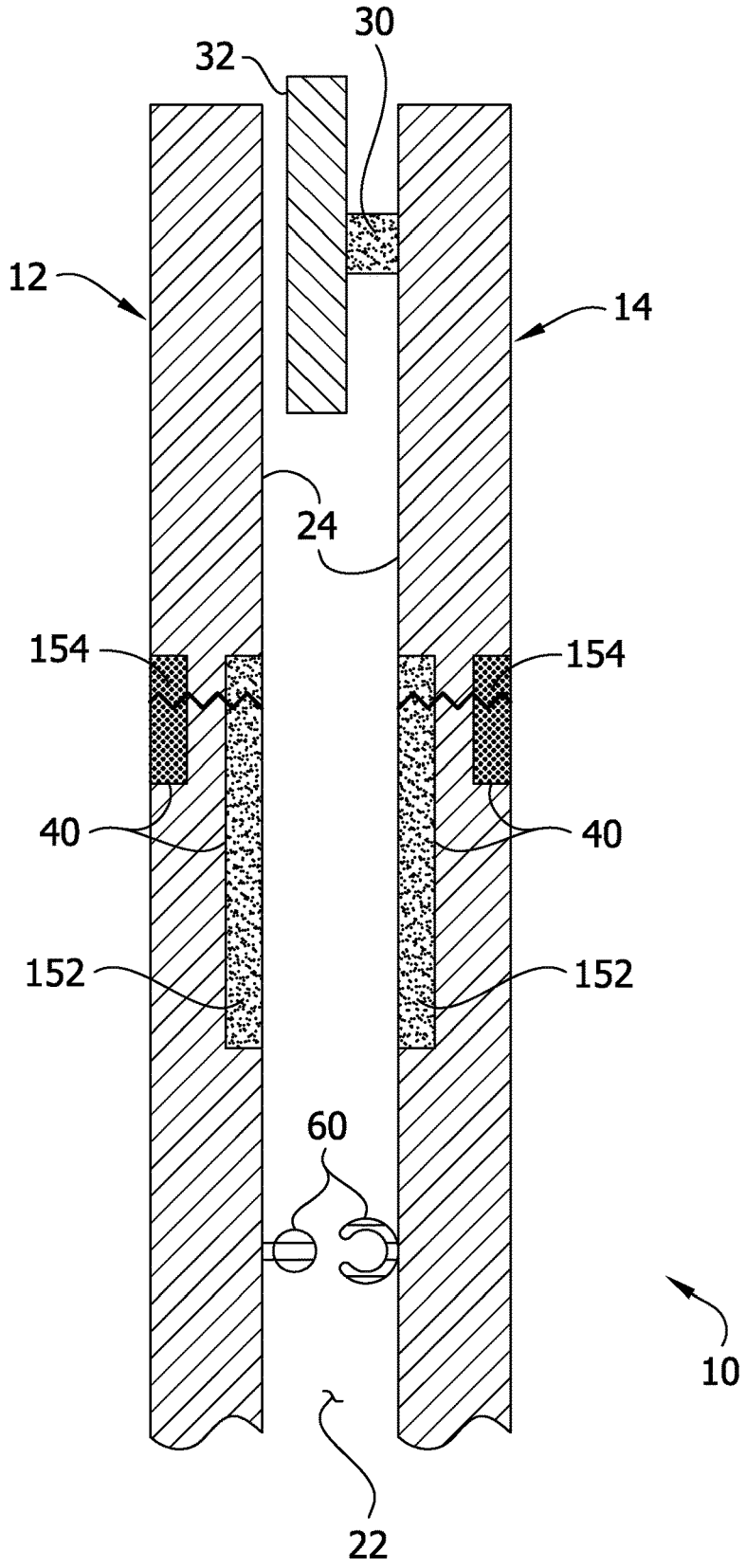
FIG. 5 is a fragmentary cross section similar to FIG. 2 of another embodiment of a sealable bag.

The miscibility of certain cling agent concentrates with component(s) of a polymer blend used to form a temporary adhesive band 40 can be addressed by co-extruding the temporary adhesive band in multiple segments. Referring to FIG. 5, in another embodiment, the temporary adhesive band 40 is divided into two segments 152, 154 such that each panel of the bag is extruded in three sections, rather than two as shown in FIGS. 1-3. An adhesive segment 152 extends along the width of each of the inboard surfaces of the bag panels 12, 14, and a weakening segment 154 extends along the width of each of the bag panels outboard of the adhesive segment. The tear line extends through the weakening segment 154 and upper portion of the adhesive segment 152 such that after tearing open the bag 10 a lower portion of the adhesive segment remains for reclosing the bag. Thus, in the embodiment illustrated in FIG. 5, the weakening segment 154 and upper portion of the adhesive segment 152 form the tear section of the temporary adhesive band 40 and the lower portion of the adhesive segment 152 forms the releasable sealing section of the tear band. The adhesive segment 152 preferably comprises an adhesive polymer blend of a polymer component and an incompatible cling agent concentrate to promote adhesiveness. In a preferred embodiment, the weakening segments 154 preferably include an immiscible polymer blend of a PE and a PP. Other weakening components such as foaming agent concentrates, etc., can also be included in the weakening segment 154 without departing from the scope of the invention. In other embodiments, other low tear strength compositions can be used for the weakening segment 154 without departing from the scope of the invention. Cling agent concentrates need not be added to the weakening segments 154. By separating the temporary adhesive band 40 into two segments 152, 154, the cling agent concentrate can be blended with a single incompatible polymer so that the cling agent concentrate migrates to the surface of the adhesive segment to promote tackiness; any suitable material can be used for the weakening segment to achieve the desired tear strength.

Referring to FIG. 4, several film constructions were tested to evaluate the effectiveness of bag panels 12, 14 created in accordance with the principles described above as compared with bag panels having more conventional constructions. The constructions of each of the films will be briefly described before describing how the tear strength and tackiness of each of the films were tested and the results of the tests. The table illustrated in FIG. 4 lists eight different films. Films A, B, and C are examples of conventional bag panel constructions, and films E, F, G, and H are examples of film constructions representative of certain bag panel constructions described above. Each of films A, B, and C is a single layer of film. Film A comprises a single layer of an LDPE, Film B comprises a single layer of a C4 LLDPE copolymer, and Film C comprises a single layer of an HDPE.

Each of films D, E, and F are two-layer films that are representative of suitable materials for the bag panels 12, 14 and tear bands 40 of the embodiment of the bag 10 illustrated in FIGS. 1-3. Each of the multilayer films D, E, and F includes a panel layer representative of a suitable bag panel material and a temporary adhesive band layer representative of a suitable temporary adhesive band material. In each film, the panel layer comprises an LDPE. The temporary adhesive band layer of the film D is a blend comprising 80% by weight C4 LLDPE and 20% by weight PIB. The temporary adhesive band layer of the film D is about 69.3% of the thickness of the film, and the panel layer is about 30.6% of the thickness. The temporary adhesive band layer of the film E is one embodiment of the first example film described above (i.e., an adhesive polymer blend comprising a PE or a PE-containing copolymer, a foaming agent concentrate, and a cling agent concentrate). The temporary adhesive band layer of the film E is composed of a polymeric blend comprising 59% by weight C5 LLDPE, 40% by weight PIB, and 1% by weight foaming agent concentrate. The temporary adhesive band layer of the film F is one embodiment of the second example film described above (i.e., an adhesive polymer blend comprising a PE or a PE-containing copolymer, a PP, a foaming agent concentrate, and a cling agent concentrate). The temporary adhesive band layer of the film F is composed of a polymeric blend comprising 44% by weight C4 LLDPE, 40% by weight PIB, 15% by weight homo PP, and 1% by weight foaming agent concentrate. In each of the films E and F, the panel layer comprises about 33.3% of the film thickness and the temporary adhesive band layer comprises about 66.7% of the film thickness. These thicknesses are representative of one embodiment of the bag panels 12, 14 where they align with the tear sections 50 of the temporary adhesive bands 40.

Each of films G and H are three-layer films that are representative of suitable materials for the bag panels 12, 14 and tear bands 40 of the embodiment of the bag 10 illustrated in FIG. 5. Each of the multilayer films G and H includes a panel layer representative of a suitable bag panel material, an adhesive segment layer representative of the adhesive segment 152, and a weakening segment layer representative of the weakening segment 154. In each film, the panel layer comprises an LDPE. The adhesive segment layer of the film G is composed of an adhesive polymeric blend of 60% by weight C4 LLDPE, and 40% by weight PIB. The weakening segment layer of the film G is composed of a polymeric blend of 99% by weight C4 LLDPE and 1% by weight foaming agent concentrate. The adhesive segment layer of the film H is composed of an adhesive polymeric blend of 60% by weight C4 LLDPE, and 40% by weight PIB. The weakening segment layer of the film H is composed of a polymeric blend of 15% by weight homo PP, 84% by weight C4 LLDPE, and 1% by weight foaming agent concentrate. In each of the films G and H, the panel layer comprises about 16.7% of the film thickness, the adhesive segment layer comprises about 16.7% of the film thickness, and the weakening segment layer comprises about 66.7% of the film thickness. These thicknesses are representative of an embodiment of the bag panels 12, 14 illustrated in FIG. 5, where the bag panels align with the adhesive segment 152 and weakening segment 154 of the tear band.

The example films listed in the table of FIG. 4 were subjected to various tests to determine the respective tear strengths and tackiness. For the tear strength, specimens were prepared with 2 cm slit on the edge and tested in accordance with Elmendorf Tear Test (ASTM D1922). As illustrated in FIG. 4, each of the films E-H had a tear strength of less than about 55 g/mil thickness (where "mil" is 10^-3 inches). Thus, in one or more embodiment, the tear section 50 of the temporary adhesive band 40 forms a zone of weakness of having a tear strength of less than about 55 g/mil thickness.

Each of the films was also subjected to a tackiness test. In the tackiness test, a sheet of each of the films was folded so that end portions of the tacky layer (if applicable; e.g., the temporary adhesive band layer of films D, E, and F and the adhesive segment layer of films G and H) of the film opposed one another. Then, according to the procedures of the tackiness test, the temporary adhesive band layer portions were pressed together using the forefinger and thumb. After 3-5 seconds, pressure applied by the fingers was released. If the temporary adhesive band layers of the film strongly adhered with each other and did not automatically separate when the finger pressure was released, the material was determined to be a tacky film under the parameters of the tackiness test. In those cases where the opposed tacky surfaces remain in contact with each other, they are peeled apart by hand to subjectively judge how easy it is to separate the joined tacky surfaces. As shown in FIG. 4, each of films D, E, F, G, and H were found to be tacky under the tackiness test, whereas conventional films were found not to be tacky under the tackiness test. Thus, in one or more embodiments, the adhesive section 52 of the tab 40 is tacky according to the tackiness test.

A method of using the bag 10 will now be briefly described. When the bag 10 is in use, the panels 12, 14 can be sealed and unsealed repeatedly with the temporary adhesive bands 40 before the release liner strip 32 is removed to permit sealing by the permanent adhesive band 30. The bag interior 22 is configured to receive items, and the temporary adhesive band 40 can be activated to sealingly close the panels 12, 14 to retain the items in the bag 10. The temporary adhesive band 40 preferably provides a leak-proof seal to prevent any leaking.

To permanently seal the panels 12, 14, the release liner strip 32 is removed from the adhesive band 30. The panels 12, 14 may then be sealed by applying pressure across the adhesive band 30, which, as described above, is a permanent adhesive. When the panels 12, 14 are permanently sealed by the adhesive band 30, it is possible to also seal the panels with the temporary adhesive band 40. Once the bag 10 has been sealed by the permanent adhesive band 30, it cannot be unsealed without destruction of the bag.

To open the bag 10 after it has been sealed by the permanent adhesive band 30, a user tears the bag along the tear line 54, tearing through the material of the tear sections 50 and the thin pieces of the panels 12, 14 that are aligned with the tear sections. After the permanently sealed outer portion 42 of the top margin 24 has been removed, the bag 10 can once again be opened to permit access to the bag interior 22. After removal of the permanently sealed outer portion 42, the bag 10 can still be repeatedly and nondestructively sealed and unsealed by the temporary adhesive band 40 and, more particularly, the releasable sealing section 52 thereof.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A plastic bag comprising;

a first panel;

a second panel, the first panel and second panel defining a bag interior and an opening at an end margin of the first and second panels to permit access to the bag interior; and a temporary adhesive band at the end margin of at least the first panel comprising a releasable adhesive having a lower tear strength than the first and second panels, the temporary adhesive band comprising:

a tear section defining a tear line along which the first panel and temporary adhesive band are configured to tear to expose the opening and permit access to the bag interior; and a releasable sealing section configured to repeatedly and nondestructively seal and unseal the first and second panels to close the opening and prevent access to the bag interior;

wherein the tear section and the releasable sealing section of the temporary adhesive band are contiguous with one another.

2. The plastic bag of claim 1 wherein the temporary adhesive band comprises a coextruded section of the first panel.

3. The plastic bag of claim 2 wherein the temporary adhesive band comprises an immiscible polymer blend.

4. The plastic bag of claim 3 wherein the immiscible polymer blend comprises a polyethylene and a polypropylene.

5. The plastic bag of claim 2 wherein the tear section and releasable sealing section of the band have a thickness and wherein the thickness of the tear section is greater than the thickness of the sealing section.

6. The plastic bag of claim 5 wherein the first panel has a thickness and wherein the thickness of the tear section is between about 70% and about 100% of the thickness of the first panel.

7. The plastic bag of claim 5 wherein the first panel has a thickness and wherein the thickness of the releasable sealing section is between about 5% to about 50% of the thickness of the first panel.

8. The plastic bag of claim 1 wherein the temporary adhesive band comprises a foaming agent concentrate.

9. The plastic bag of claim 1 wherein the temporary adhesive band comprises a cling agent concentrate.

10. The plastic bag of claim 9 wherein the cling agent concentrate comprises polyisobutylene.

11. The plastic bag of claim 1 further comprising a temporary adhesive band at the end margin of the second panel comprising a releasable adhesive having a lower tear strength than the first and second panels, the temporary adhesive band at the end margin of the second panel comprising:

a tear section defining a tear line along which the second panel is configured to tear to expose the opening and permit access to the bag interior; and a releasable sealing section configured to repeatedly and nondestructively seal and unseal the first and second panels to close the opening and prevent access to the bag interior.

12. The plastic bag of claim 11 wherein the temporary adhesive band of the first panel is oriented to contact the temporary adhesive band of the second panel when the temporary adhesive bands are used to seal the opening.

13. The plastic bag of claim 1 wherein the tear section is non-perforated.

14. The plastic bag of claim 1 wherein the temporary adhesive band comprises a polymer blend and the first panel comprises a polymer of a type, the polymer blend being partially composed of a polymer of the same type.

15. The plastic bag of claim 1 wherein the tear section is disposed outboard of the releasable sealing section.

16. The plastic bag of claim 1 further comprising a zippered seal.

17. The plastic bag according to claim 1, wherein the releasable sealing structure provides a leak-proof seal of the bag interior.

18. The plastic bag according to claim 1 further comprising a permanent sealing structure configured to permanently seal the first and second panels at an outer portion of the end margin outboard of the temporary adhesive band and prevent access to the bag interior such that the bag cannot be reopened without destruction of the bag.

19. A temporary adhesive band in a plastic bag comprising at least one bag panel, the temporary adhesive band being located adjacent an opening of the bag at an end margin of the panel, the temporary adhesive band comprising:

a releasable adhesive having a lower tear strength than the first and second panels;

a tear section defining a tear line along which the first panel is configured to tear to expose the opening and permit access to an interior of the bag; and a releasable sealing section configured to repeatedly and nondestructively seal and unseal the first and second panels to close the opening and prevent access to the bag interior;

wherein the tear section and the releasable sealing section are made of the same material and are coextruded with the bag panel.

20. A plastic bag comprising;

a first panel;

a second panel, the first panel and second panel defining a bag interior and an opening at an end margin of the first and second panels to permit access to the bag interior; and a temporary adhesive band at the end margin of at least the first panel having a top edge and a bottom edge, the temporary adhesive band comprising a releasable adhesive having a lower tear strength than the first and second panels and being configured to repeatedly and nondestructively seal and unseal the first and second panels to close the opening and prevent access to the bag interior, the temporary adhesive band defining a tear line along which the first panel is configured to tear to expose the opening and permit access to the bag interior;

wherein the temporary adhesive band has a height extending between the top edge and the bottom edge and the releasable adhesive both is confined to the height and extends continuously along the height from the bottom edge to the top edge.

21. The plastic bag of claim 20 wherein the tear line is at an outer side of the temporary adhesive band such that a releasable sealing section of the temporary adhesive band remains attached to the first panel after the first panel is torn along the tear line to remove a portion of the first panel, the releasable sealing section of the temporary adhesive band being configured to repeatedly and nondestructively seal and unseal the first and second panels to close the opening and prevent access to the bag interior after the first panel is torn along the tear line.

* * * * *